US005724058A

United States Patent [19]

Choi et al.

[11] Patent Number: 5,724,058

[45] Date of Patent: Mar. 3, 1998

[54] GRAY SCALE DISPLAY DRIVING METHOD OF A MATRIX LIQUID CRYSTAL DISPLAY AND DRIVING APPARATUS THEREFOR

[75] Inventors: Sun-jung Choi, Suwon; Cheol-woo Park, Suwon; Choon-yul Oh, Anyang; Min-seok Kim, Suwon, all of Rep. of Korea

[73] Assignee: Samsung Display Devices Co., Ltd., Kyungki-do, Rep. of Korea

[21] Appl. No.: 547,920

[22] Filed: Oct. 25, 1995

[30] Foreign Application Priority Data

Sep. 6, 1995 [KR] Rep. of Korea ..... 95-29161

[51] Int. Cl.[6] ..... G09G 3/36

[52] U.S. Cl. ..... 345/89; 345/149; 358/458

[58] Field of Search ..... 345/89, 147, 149, 345/155; 358/455, 458

[56] References Cited

U.S. PATENT DOCUMENTS 5,254,982 10/1993 Feigenblatt et al. ..... 345/89

5,463,478 10/1995 Makita et al. ..... 358/458

*Primary Examiner*—Kee M. Tung

*Assistant Examiner*—Matthew Luu

*Attorney, Agent, or Firm*—Leydig, Voit & Mayer, Ltd.

[57] ABSTRACT

A gray scale display driving method of a matrix liquid crystal display (LCD) and a display driver implementing this method, can reduce the scanning and data electrode driving signal voltages and the driving voltage magnitude variation for the respective sub-frames and can improve the picture quality. The method includes the steps of determining an n-bit error-diffused value of N-bit picture data, where n is smaller than N, converting the N-bit picture data into an M-bit code, where M is larger than or equal to N, error-diffusing n-bits of the converted picture data, and displaying picture data of M-n bits, with n bits being error-diffused, as a picture by a gray display method.

9 Claims, 9 Drawing Sheets

$$G_1(t) = -cF_1(t) + cF_2(t) - cF_3(t) + cF_4(t) + cF_5(t)$$

eA = (7/16) eP, eB = (1/16) eP,
eC = (5/16) eP, eD = (3/16) eP

GRAY SCALE DISPLAY DRIVING METHOD OF A MATRIX LIQUID CRYSTAL DISPLAY AND DRIVING APPARATUS THEREFOR

BACKGROUND OF THE INVENTION

The present invention relates to a gray scale display driving method of a matrix liquid crystal display (LCD) and a driving apparatus therefor, which can lower driving voltages, and considerably reduce the variation in magnitudes of driving voltages for sub-frames without deterioration of gray levels.

A simple matrix LCD device is largely composed of scanning electrodes which control scanning lines of the display device and data electrodes which control a data display on each pixel when the respective scanning lines are selected. A voltage averaging method adopting a line sequential driving method using multiplexing is the standard simple matrix LCD driving method. FIGS. 1A through 1D are waveform diagrams of scanning and data electrode driving signals and signals applied to pixels when a simple matrix LCD composed of 2×6 pixels is driven by a voltage averaging method using a line sequential driving method. Pulses (scanning electrode driving signals) of a voltage Vs are sequentially applied to scanning electrodes 1, 2, 3, 4, 5 and 6, as shown in FIG. 1A, and pulses (data electrode driving signals) of voltages $+V_d$ and $-V_d$ are applied to data electrodes 1 and 2. Therefore: as shown in FIG. 1D, LCD is driven by pixel signals (voltages $V_d$, $2V_d$, $3V_d$ and $-V_d$) shown in FIG. 1C which are formed by averaging voltages $V_s$ and $V_d$. However, this method is used only when the liquid crystal response is slow, that is, when the response time of LCD is about 400 msec, without losing picture contrast. Therefore, a multi-line scanning (MLS) method or an active addressing (AA) method is used where high-speed response characteristics are requested, i.e., a quick response to the transfer speed of a computer mouse or to a moving picture display speed.

FIG. 2 shows the driving method of scanning and data electrodes when the LCD is driven adopting the MLS method or AA method. As shown, according to the AA method, a plurality of scanning electrodes $F_1(t)$ to $F_5(t)$ are simultaneously selected at a time t to be driven. At this time t, the data electrode is driven by a data electrode driving signal represented by the relationship $G_1(t)=-cF_1(t)+cF_2(t)-cF_3(t)+cF_4(t)+cF_5(t)$, which is applied to the data electrode $G_1$. In the end, two pixels are turned on. In this manner, this method can be adopted for a high-speed responsive LCD, owing to the increased duty ratio of the LCD by simultaneously driving a plurality of electrodes. However, this method requires many data voltage levels. Also, it requires additional storage device and operation circuit for screen data under the current driving circumstances.

As described above, according to the voltage averaging method using a line sequential driving method, only one scanning electrode is selected to be sequentially driven. According to the AA method, a plurality of electrodes are simultaneously selected to be sequentially driven.

There are six methods of displaying gray levels by adopting the voltage averaging method using a line sequential driving method or the AA method using the MLS method; frame modulation gray display, amplitude modulation gray display, area partition gray display, voltage and frame modulation gray display, voltage magnitude modulation gray display and error diffusion gray display.

1. Frame Modulation Gray Display Method

This method is most widely used for a simple matrix LCD, by which a plurality of sub-frames are set as a display unit of a screen to be driven. In other words, a gray level is represented by the number of bouts for "ON" state selecting sub-frames among the plurality of sub-frames. Since both the scanning electrode driving signal and the data electrode driving signal have only binary values in driving a simple matrix LCD which can control only the liquid crystal state of ON and OFF, this method has been widely used as a standard gray display method owing to its low cost. However, with the increased displayed gray levels, the display frequency of a screen becomes low, which makes it difficult to acquire a display speed for implementing motion pictures, a recent trend in the video field. Also, flickering of the screen due to the lowered display frequency degrades picture quality.

FIG. 3 shows a frame modulation gray display method for implementing 8 gray levels with 7 sub-frames. Here, the pulse width and voltage of a scanning electrode driving signal and the reference voltage are designated by t(s), V(s) and $V_{ns}$, respectively. The pulse voltage of a data electrode driving signal is composed of $+V_d$ and $-V_d$. As shown in FIG. 3, since the picture signal frequency (data electrode driving signal frequency) is noticeably reduced in the second and seventh gray level displays, the number of sub-frames are substantially increased to increase the frequency for displaying second and seventh gray levels.

2. Amplitude Modulation Gray Display Method.

This method has the advantage that a data electrode driving signal (X) and a scanning electrode driving signal (Y) having a selection pulse width (d) are driven with only two voltage levels, respectively, as shown in FIG. 4. However, since the pulse width (f) of data electrode driving signal voltage should be partitioned according to the number of gray levels considered as being realized, the frequency of data electrode driving signal is increased. Also, the LCD itself cannot respond quickly to a fast data electrode driving signal, which limits the number of gray levels to be displayed.

3. Area Partition Gray Display Method

This method suffers from the problems of low resolution and increased driven integrated circuits and screen scanning lines due to partition and is not used except specific cases.

4. Voltage and Frame Modulation Gray Display Method

This method adjusts the magnitude of a driving signal voltage by allotting sub-frames of one bout by the respective bits of a data electrode driving signal in consideration of weight values of the respective bits, as shown in FIG. 5. Since the data system is 8:4:2:1 in the voltage and frame modulation gray display method for displaying 16 gray levels shown in FIG. 5, the magnitude ratio of driving signal voltages $V_s$ and $V_d$ by frames is $2\sqrt{2}:2:\sqrt{2}:1$. In other words, the driving signal voltage difference between the respective sub-frames is large, and the magnitude of the driving signal voltage is increased accordingly. In this method, the magnitude of the scanning electrode driving signal $V_s$ becomes about 35.4V if MSB data is driven under the conditions of the duty 1/240 and Vth 2.0 V. It shows an increase of Vs of about 1.56 times as compared with that in the frame modulation gray display method. The magnitude of the scanning electrode driving signal $V_s$ becomes about 22.65V under the same conditions above. Therefore, since the driving signal voltage magnitude difference by driving voltage levels and sub-frames becomes larger with an increased number of gray levels, the number of displayed gray levels should be limited. In spite of severe driving signal voltage difference between sub-frames, since this method minimizes the driving voltage levels of data electrodes and reduces the number of sub-frames considerably, it is considered to be very highly attractive for the future.

5. Voltage Magnitude Modulation Gray Display Method

This method is notable for realizing a quick responsive LCD using a plural electrode simultaneous selection method (AA method). A typical example thereof is the pulse height modulation (PHM) shown in FIG. 6. Here, pulses having different heights of a data electrode driving signal (Y) are applied to a data electrode by a half period (dt/2) of the selection pulse width (dt) of a scanning electrode driving signal (X). In this case, since numerous driving voltage levels of a data electrode are necessary, the driving cost of an IC is greatly increased. Also, in the case of an analog IC, a data processing speed is low.

6. Error Diffusion Gray Display Method

This method which implements a gray picture by performing spatial modulation using a picture processing technology greatly reduces the driving cost of a picture display device and easily obtains the sufficient number of gray levels.

The spatial modulation method using error diffusion is generally performed by an error diffusion system, as shown in FIG. 7. In this system, a effective value ($U_{m,n}$) obtained by adding an error value ($e'_{m,n}$) generated at the previous pixels to original picture data ($X_{m,n}$) considered as being displayed is approximated into a quantization value ($b_{m,n}$) to be used as picture display data, and the difference between the effective value ($U_{m,n}$) and quantization value ($b_{m,n}$) is set as a new error value ($e_{m,n}$) to be diffused into adjacent pixels in a predetermined ratio according to the error diffusion method. These operations are sequentially adopted according to the scanning direction, thereby displaying desired gray levels. Here, Q(*) represents a quantizer and $h_{m,n}$ represents an lowpass filter. The respective values of a error diffusion system are defined by the following equations.

$$U_{m,n}=X_{m,n}+e'_{m,n}$$

$$b_{m,n}=Q(U_{m,n}) \text{ (quantized)}$$

$$e_{m,n}=U_{m,n}-b_{m,n}$$

$$e'_{m,n}=h_{m,n}(e_{m,n}) \text{ (low-pass filtering)}$$

As a method of diffusing the error values generated by the system into adjacent pixels, the Floyd & Steinberg algorithm is most widely used. The Javis algorithm, Judice & Ninke algorithm and a Stucki algorithm are also widely used. In addition, various algorithms are being developed. According to the Floyd & Steinberg algorithm, as shown in FIG. 8, an error diffusion is executed to diffuse errors from a pixel P into adjacent pixels A, B, C and D by 7/16(eA), 1/16(eB), 5/16(eC) and 3/16(eD), respectively. At this time, picture data is error-diffused in the sequence shown in FIG. 10. In other words, if picture data of N bits is input, n bits are error-diffused and then N-n bit picture data is displayed as a picture.

However, this method suffers from the problem that a saturated region is generated at an MSB gray level.

FIG. 9 shows gray display states according to the gray display capability of a display device in the case of displaying 8-bit data by the error diffusion method. Here, a solid line a depicts a gray display state in the case of an LCD having two gray levels, in which the gray levels exceeding 128 (a half of the maximum gray display number of 8-bit data, $2^8$=256) becomes saturated, thereby preventing discrimination between the gray levels. Lines b, c and d depict gray display states in the case of LCDs having 4, 8 and 16 gray levels, respectively.

As shown in FIG. 10, according to the conventional error diffusion method, among input N-bit picture data, n bits from the LSB are data-processed according to the error diffusion algorithm and then among the resulting modulated picture data, N-n bits from the MSB are output to a picture display device.

SUMMARY OF THE INVENTION

To solve the above problems, it is an object of the present invention to provide a method for driving a matrix liquid crystal display (LCD), which can greatly reduce driving voltage and the difference between the driving voltage levels and minimize the lowering of picture quality.

To accomplish the above object, there is provided a method for driving a matrix LCD comprising the steps of: determining an n-bit error-diffused value of N-bit picture data, where n is smaller than N; converting the N-bit picture data into an M-bit code, where M is larger than or equal to N; error-diffusing n-bits of the converted picture data; and displaying picture data of M-n bits with n bits being error-diffused, as a picture by a gray display method.

Preferably, the lowest siginificant bit is error-diffused if the error-diffused value is less than or equal to 1; the lower two significant bits are error-diffused if the error-diffused value is less than or equal to 2; the lower two significant bits are error-diffused if the error-diffused value is less than or equal to 3; and the lower three significant bits are error-diffused if the error-diffused value is less than or equal to 7.

Preferably, the maximum of the converted M-n bits is determined to be the same as the maximum value of the N-bit picture data.

Also, preferably, the picture data codes are converted so that the difference between weight values for the respective bits of the converted M-n bit picture data is smaller than than of the N-bit picture data.

Also, there is provided a matrix liquid crystal display driving apparatus comprising: means for (a) determining an n-bit error-diffused value of N-bit picture data, where n is smaller than N; (b) converting the N-bit picture data into an M-bit code, where M is larger than or equal to N; and (c) error-diffusing n-bits of the converted picture data; and means for displaying picture data of M-n bits with n bits being error-diffused by a gray display method.

Preferably, the driving apparatus is adopted to operate according to the method of the invention.

BRIEF DESCRIPTION OF THE INVENTION

The above objects and advantages of the present invention will become more apparent by describing in detail a preferred embodiment thereof with reference to the attached drawings in which.

DETAILED DESCRIPTION OF THE INVENTION

The present invention is a new gray scale display method, in which a conventional picture binary data code system is converted into an optimum code considering LCD characteristics and system circumstances such as the number of sub-frames for a gray scale display driving or driving voltage condition. Gray levels whose occurrence frequencies are low are partially error-diffused among the converted code values and a gray scale driving method is implemented by voltage and frame modulation.

Figure 10:
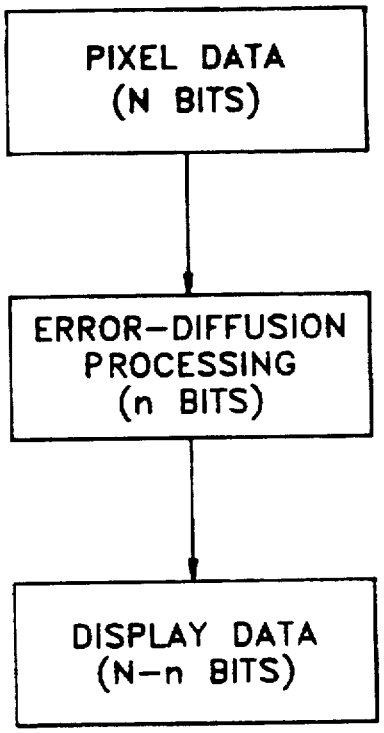
FIG. 10 (PRIOR ART)
FIG. 10 is a flowchart of a picture data process using a conventional error diffusion method.
Figure 11:
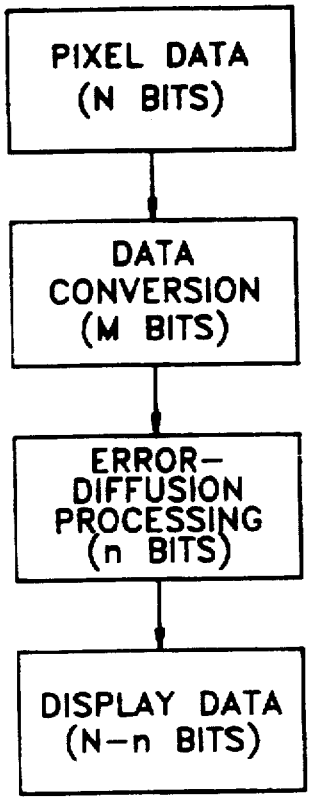
FIG. 11 is a flowchart of a picture data process using an error diffusion method according to the present invention.

FIG. 11 shows a picture data sequence using an error diffusion method according to the present invention. In contrast to the picture gray display method using the conventional error diffusion method shown in FIG. 10, in a new pixel gray level display method according to the present invention, as shown in FIG. 11, the picture data of a binary code is converted into M-bit code which is an optimum type for the gray level display of an LCD before applying an error-diffusion method with respect to input picture data, n bits of the converted M-bit picture data are error-diffused in the same method as the conventional one, and then picture data of M-n bit from the most significant bit (MSB) is output to the LCD.

The picture gray display method will now be described in more detail.

First, the following algorithm converts the binary code system of picture data into an optimum code for driving the LCD.

1. The error-diffused value of an input N-bit picture data code is determined as the lower n significant bits:
   - 1 bit (least significant bit (LSB)) if the error-diffused value is less than or equal to 1;
   - 2 bits (LSB, LSB+1) if the error-diffused value is less than or equal to 2;
   - 2 bits (LSB, LSB+1) if the error-diffused value is less than or equal to 3; and
   - 3 bits (LSB, LSB+1, LSB+2) if the error-diffused value is less than or equal to 7.
2. The picture data code is converted from a binary code into an M-bit code which is optimum for gray scale display for the LCD:
   - the conversion is performed so that the maximum gray scale display value of M-n-bit code becomes the same with the maximum gray scale display value of original input N-bit picture data code; and
   - the data code is set for the weight value difference for the respective bits of M-n-bit picture data to be relatively small.

As a practical example of the optimum code conversion method, in order to implement 16 gray levels with 4 sub-frames constituted by 4-bit data, as in the conventional voltage and frame modulation gray display method, the code conversion is performed in the following sequence.

Figure 12:
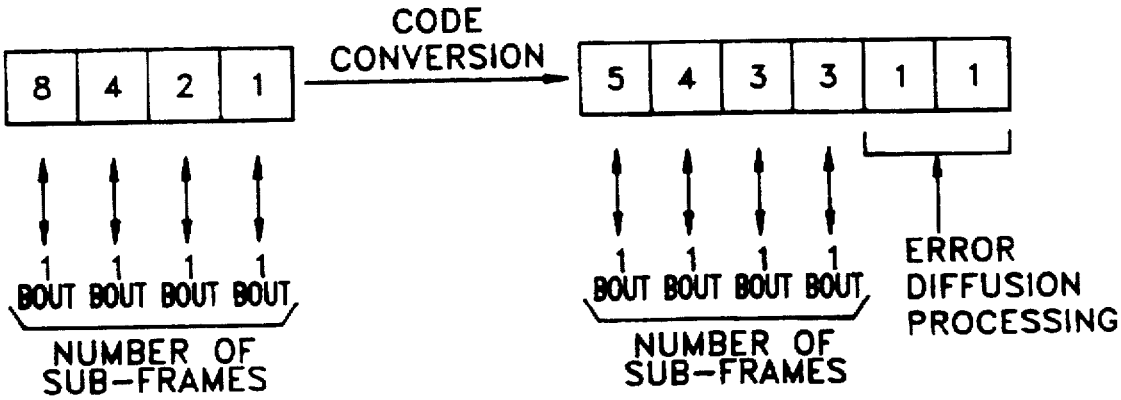
FIG. 12 is a diagram showing a picture data code conversion according to an embodiment of the present invention.

First, the error-diffused value is determined to be less than or equal to 2. The input picture data bits (4 bits) of a binary code and converted data bits (6 bits) are shown in FIG. 12.

Next, the data conversion into an optimum code is performed. A data code is set so that the total sum of the upper four significant bit values among the converted data bits (6 bits) becomes 15 and the difference between weight values for the respective bits of the upper four significant bits is as small as possible. In other words, the weight values ranging in the ratio of 8:4:2:1 is converted into that of 5:4:3:3(:1:1). Also, as shown in the following table 1, the upper four significant bits of the converted code 5:4:3:3:1:1 are driven by the voltage and frame gray display method and the lower two significant bits of the code 1:1 are error-diffused. Therefore, the gray levels displayed by the voltage and frame gray display method are twelve, that is, 0, 3, 4, 5, 6(3+3), 7(4+3), 8(5+3), 9(5+4), 10(4+3+3), 11(5+3+3), 12(5+4+3) and 15(5+4+3+3), respectively. The remaining gray levels, 1, 2, 13 and 14, whose weight values are low are implemented by the error diffusion method. In other words, it is understood that only the gray levels having low occurrence probability are error-diffused.

TABLE 1

| Code | Binary code | | | | Converted code | | | | | |
|---|---|---|---|---|---|---|---|---|---|---|
| Weight value | 8 | 4 | 2 | 1 | 5 | 4 | 3 | 3 | 1 | 1 |
| 0 | 0 | 0 | 0 | 0 | 0 | 0 | 0 | 0 | 0 | 0 |
| 1 | 0 | 0 | 0 | 1 | 0 | 0 | 0 | 0 | 0 | 1 |
| 2 | 0 | 0 | 1 | 0 | 0 | 0 | 0 | 0 | 1 | 1 |
| 3 | 0 | 0 | 1 | 1 | 0 | 0 | 0 | 1 | 0 | 0 |
| 4 | 0 | 1 | 0 | 0 | 0 | 1 | 0 | 0 | 0 | 0 |
| 5 | 0 | 1 | 0 | 1 | 1 | 0 | 0 | 0 | 0 | 0 |
| 6 | 0 | 1 | 1 | 0 | 0 | 0 | 1 | 1 | 0 | 0 |
| 7 | 0 | 1 | 1 | 1 | 0 | 1 | 1 | 0 | 0 | 0 |
| 8 | 1 | 0 | 0 | 0 | 1 | 0 | 0 | 1 | 0 | 0 |
| 9 | 1 | 0 | 0 | 1 | 1 | 1 | 0 | 0 | 0 | 0 |
| 10 | 1 | 0 | 1 | 0 | 0 | 1 | 1 | 1 | 0 | 0 |
| 11 | 1 | 0 | 1 | 1 | 1 | 0 | 1 | 1 | 0 | 0 |
| 12 | 1 | 1 | 0 | 0 | 1 | 1 | 1 | 0 | 0 | 0 |
| 13 | 1 | 1 | 0 | 1 | 1 | 1 | 1 | 0 | 0 | 1 |
| 14 | 1 | 1 | 1 | 0 | 1 | 1 | 1 | 0 | 1 | 1 |
| 15 | 1 | 1 | 1 | 1 | 1 | 1 | 1 | 1 | 0 | 0 |

Second, although the conventional Floyd and Steinberg algorithm is used as an error diffusion method, a new error diffusion method may be proposed to be used according to usages.

Third, partially error diffusion processed data with respect to 1, 2, 13 and 14 gray levels of low occurrence, obtained by an example adopted for implementing a gray display using the voltage and frame modulation gray display method, are driven by the voltage and frame modulation gray display method for the gray display for an LCD. The driven picture data is composed of a new 4-bit code having weight value ratio of 5:4:3:3 and one sub-frame is allotted to each bit to then be driven.

The values of the scanning electrode driving signal voltage $V_{sl}$ and the data electrode driving signal voltage $V_{dl}$ are obtained in the following manner, respectively. Since the data bit weight value ratio is 5:4:3:3, these values are standardized with respect to the LSB weight value (3) to become 5/3:4/3:1:1. Based on the standardized weight value ratio, the data voltage Vd1 for the LSB data is obtained as:

$$V_{d1} = \sqrt{12/15}\ \sqrt{\frac{\sqrt{N}}{2(\sqrt{N}-1)}}\ V_{th}$$

where N represents the number of scanning electrodes, which is replaced by the value of Vd of the conventional APT (Alto-Pleshko Technique) method to give the following equation:

$$V_{d1} = \sqrt{12/15}\ V_d$$

where since $V_d$=1.462V in case of 240 scanning electrodes and 2V of Vth, the following equation is obtained.

$$V_{dl}=1.308V$$

The scanning electrode driving signal voltage $V_{sl}$ is obtained from the equation $V_{sl}=\sqrt{N}V_{dl}$ as follows:

$$V_{sl}=20.263V$$

The values obtained in the above two equations represent data and scanning electrode driving signal voltages for driving the LSB, respectively.

The data and scanning electrode driving signal voltages for driving the MSB are as follows:

$$V_{d1} = \sqrt{5/3} \times 1.308\ V - 1.689\ V$$

$$V_{s1} = \sqrt{5/3} \times 20.263\ V = 26.162\ V$$

Figure 13:
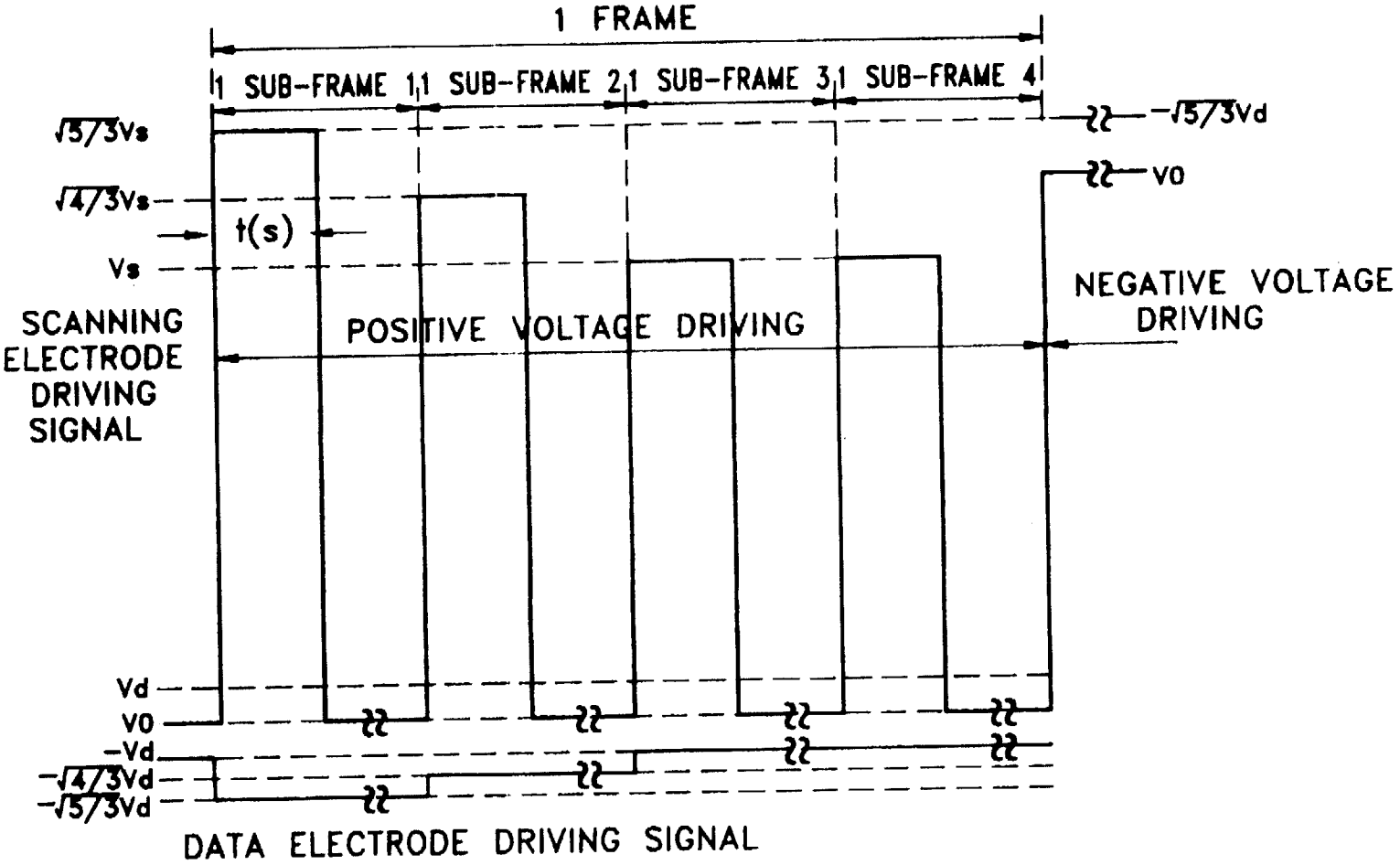
FIG. 13 shows waveform diagrams of examples of scanning and data electrode driving signals by a gray picture display method according to the present invention.

Table 2 indicates the driving conditions of the present invention, and FIG. 13 shows an example of a waveform for implementing 16 gray levels using 4 sub-frames when adopting the method according to the present invention. The respective voltage values of $V_s$ and $V_d$ have the ratio of $$\sqrt{\frac{5}{3}} : \sqrt{\frac{4}{3}} : 1 : 1.$$

TABLE 2

| Method | Gray display method of the invention | | | |
|---|---|---|---|---|
| Data code value | 5 | 4 | 3 | 3 |
| Scanning electrode driving signal voltage (Vs) | 26.162 | 23.395 | 20.263 | 20.263 |

TABLE 2-continued

| Method | Gray display method of the invention | | | |
|---|---|---|---|---|
| Data code value | 5 | 4 | 3 | 3 |
| Data electrode driving signal voltage (Vd) | 1.689 | 1.510 | 1.308 | 1.308 |

Figure 14:
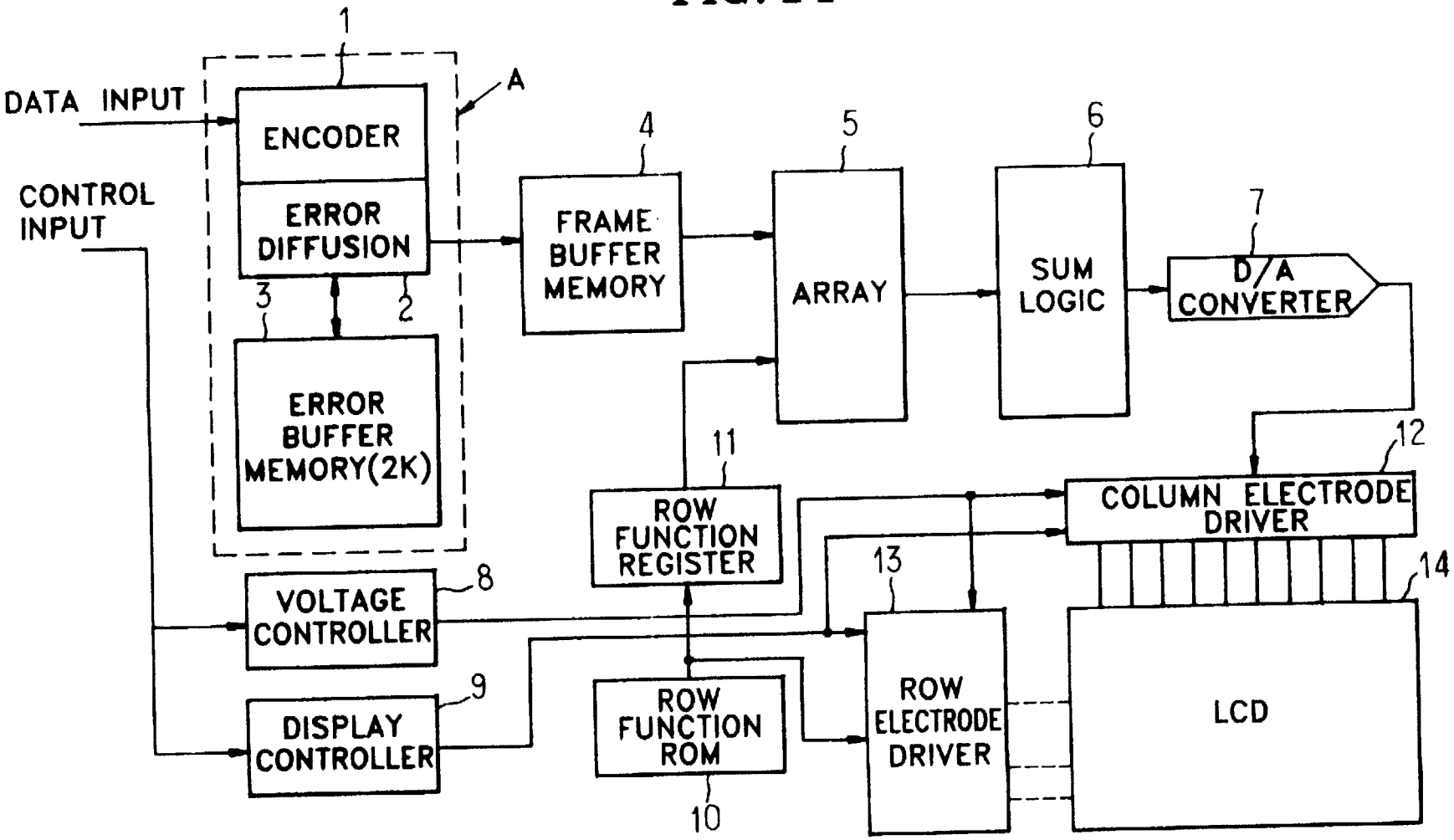
FIG. 14 is a block diagram of an LCD driving apparatus using the gray picture display method according to present invention.

FIG. 14 shows an LCD driving apparatus adopting the gray display method according to the present invention, which is implemented only by adding an encoder, error diffusion logic and a buffer memory to the circuitry of the conventional MLS or AAT method, as shown in a block "A" of FIG. 14.

According to another embodiment of the present invention, 16 gray level can be realized with 3 sub-frames in such a manner that conventional weight value data code 8:4:2:1 is converted into 7:5:3:1:1, the lower two significant bits are error-diffused and then data values 7:5:3 are driven by the voltage and frame modulation gray display method.

As described above, the conventional binary picture data code system is converted into another code system for various applications and is useful for all kinds of display devices such as cathode ray tube, plasma display panel or electro-luminescence display as well as liquid crystal display.

The effects obtained by using the aforementioned gray display method according to the present invention will be described with reference to table 3 in comparison with the characteristics of the conventional gray display methods.

TABLE 3

| Method | Method 1 | Method 2 | Method 3 | Method 4 |
|---|---|---|---|---|
| Maximum Vs | 33.076 | 29.682 | 26.162 | 26.802 |
| Maximum Vd | 2.135 | 1.916 | 1.689 | 1.73 |
| Vs variation | 21.38 | 14.841 | 5.899 | 9.256 |
| Vd variation | 1.38 | 0.958 | 0.381 | 0.5974 |

In table 3, method 1 is the conventional voltage and frame modulation gray display method, by which 16 gray levels are displayed by constituting 4 sub-frames from a picture data code having weight values of 8:4:2:1. Method 2 displays 16 gray levels by constituting 3 sub-frames from a picture data code having weight values of 8:4:2 for the remaining upper three significant bits after error-diffusing the LSB of data code 8:4:2:1 in method 1. Method 3 corresponding to the first embodiment of the present invention displays 16 gray levels by error-diffusing the lower two significant bits (1:1) and constituting 4 sub-frames for the remaining upper four significant bits after converting the picture data code having the conventional weight values of 8:4:2:1 into the data code having the weight values of 5:4:3:3:1:1. Method 4 corresponding to the second embodiment of the present invention displays 16 gray levels by error-diffusing the lower two significant bits (1:1) and constituting 3 sub-frames for the remaining upper three significant bits after converting the picture data code having the conventional weight values of 8:4:2:1 into the data code having the weight values of 7:5:3:1:1.

The above table 3 indicates the maximum scanning electrode driving voltage, maximum data electrode driving signal voltage, the scanning electrode driving signal voltage variation between the respective sub-frames and the data electrode driving signal voltage variation between the respective sub-frames.

As shown in table 3, methods 3 and 4 according to the present invention have low driving signal voltages than those of conventional methods 1 and 2. In other words, the driving signal voltages in methods 3 and 4 are 79% and 81% lower than that in method 1, respectively, and are 88% and 90% lower than that in method 2, respectively. Also, methods 3 and 4 according to the present invention have low variations than those of conventional methods 1 and 2. In other words, the driving voltage variation between the respective sub-frames are 28% and 43% lower than that in method 1, respectively, and are 40% and 62% lower than that in method 2, respectively.

Therefore, the cost for driving ICS can be reduced and crosstalk can be reduced, owing to a stabilized picture display and a small driving signal, which are caused by using a stable electrode driving signal having low variation. A small driving signal has a small voltage inducing a differential wave produced adjacent electrodes.

The following table 4 indicates effective voltages for the respective gray levels for the methods 3 and 4 according to the present invention.

TABLE 4

| Gray level | Method 3 (Vrms) | Method 4 (Vrms) |
|---|---|---|
| Gray 0 | 2.0 | 2.0 |
| Gray 1 | Error diffused | Error diffused |
| Gray 2 | Error diffused | Error diffused |
| Gray 3 | 2.0278 | 2.027 |
| Gray 4 | 2.0369 | Error diffused |
| Gray 5 | 2.04597 | 2.045 |
| Gray 6 | 2.05475 | Error diffused |
| Gray 7 | 2.06373 | 2.063 |
| Gray 8 | 2.07268 | 2.072 |
| Gray 9 | 2.08159 | Error diffused |
| Gray 10 | 2.09045 | 2.090 |
| Gray 11 | 2.09929 | Error diffused |
| Gray 12 | 2.10784 | 2.107 |
| Gray 13 | Error diffused | Error diffused |
| Gray 14 | Error diffused | Error diffused |
| Gray 15 | 2.1335 | 2.1335 |

Figure 1A:
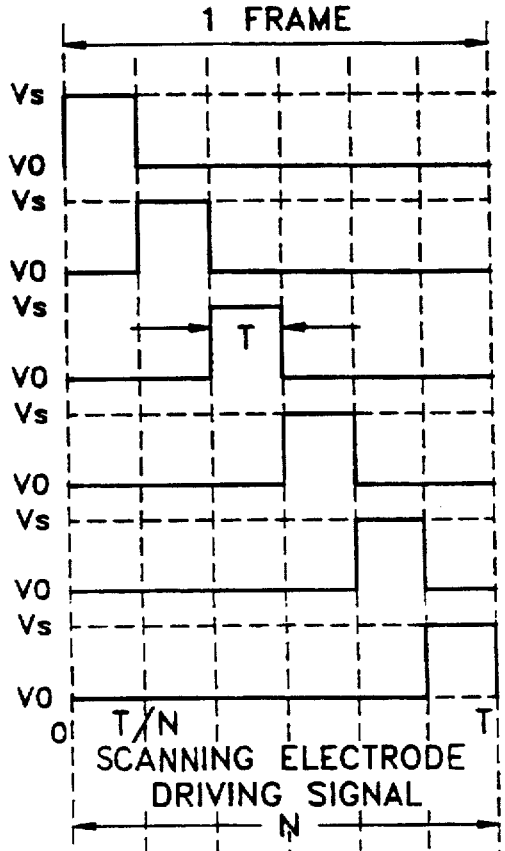
FIG. 1A (PRIOR ART)
FIGS. 1A through 1D are waveform diagrams of scanning and data electrode driving signals and signals applied to pixels by the voltage averaging method using a line sequential driving method.
Figure 1B:
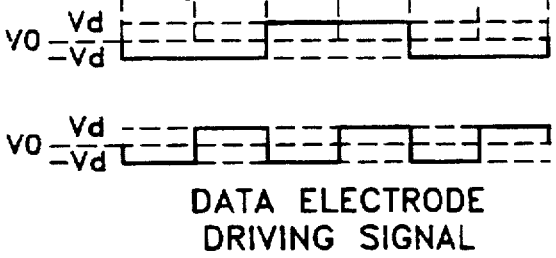
FIG. 1B (PRIOR ART)
Figure 1D:
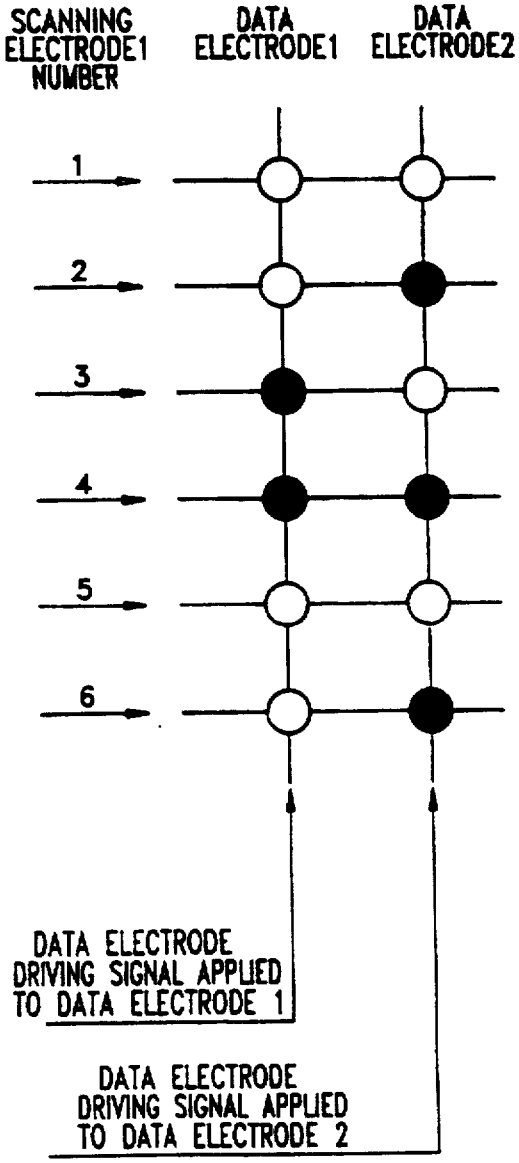
FIG. 1D (PRIOR ART)
Figure 1C:
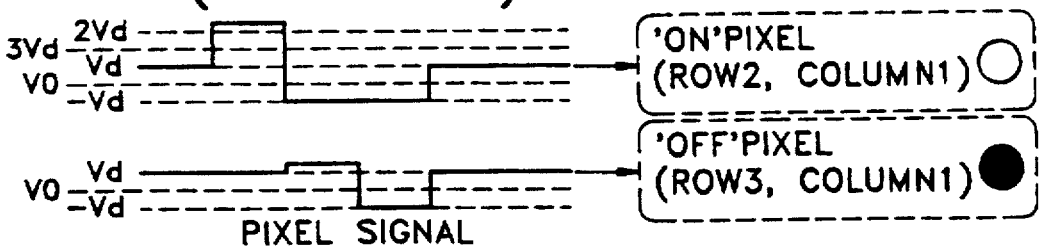
FIG. 1C (PRIOR ART)
Figure 2:
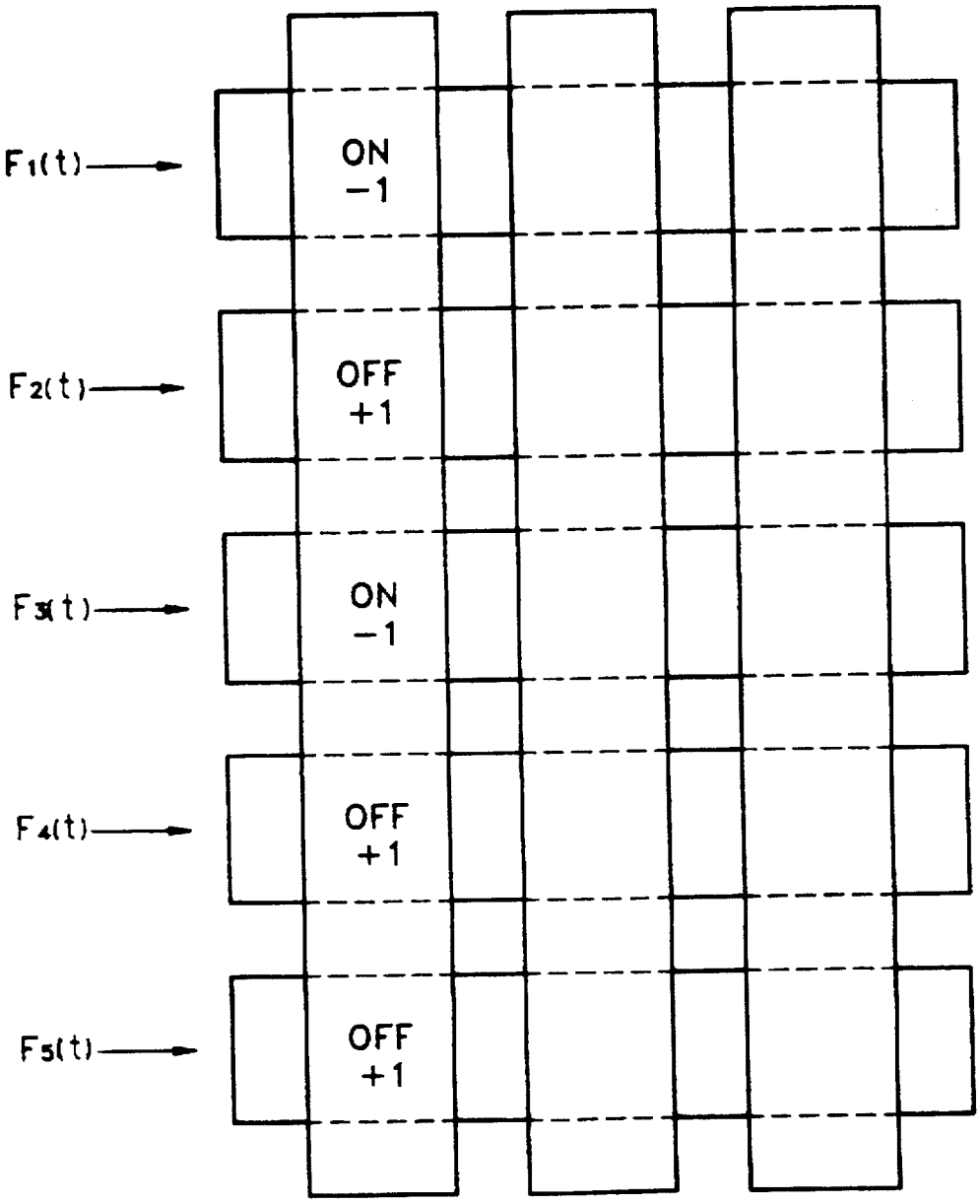
FIG. 2 (PRIOR ART)
FIG. 2 shows the driving method of scanning and data electrodes when the LCD is driven adopting the MLS method or AA method.
Figure 3:
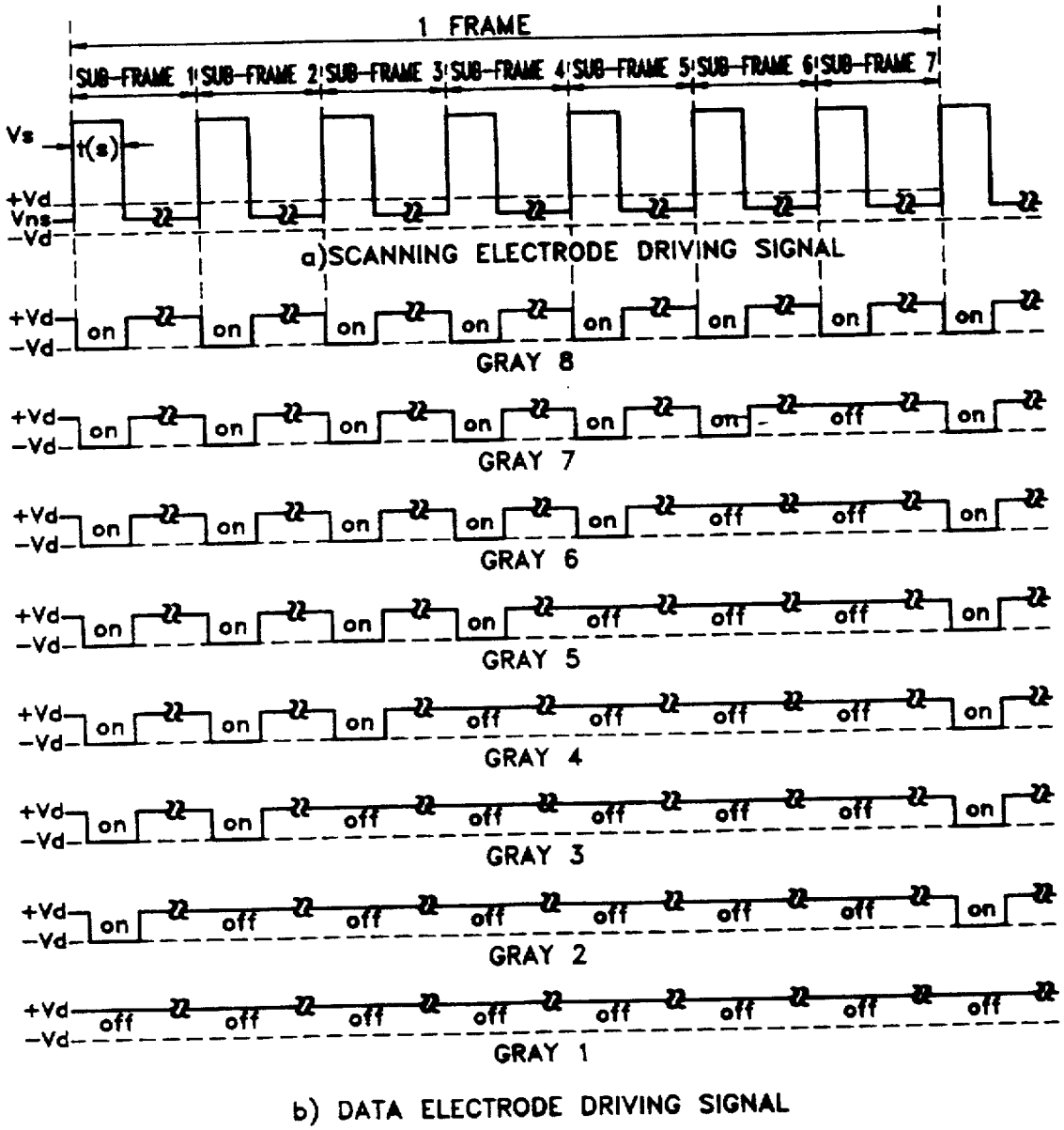
FIG. 3 (PRIOR ART)
FIG. 3 shows waveform diagrams of scanning and data electrode driving signals adopting a conventional frame modulation gray display method for displaying 8 gray levels.
Figure 4:
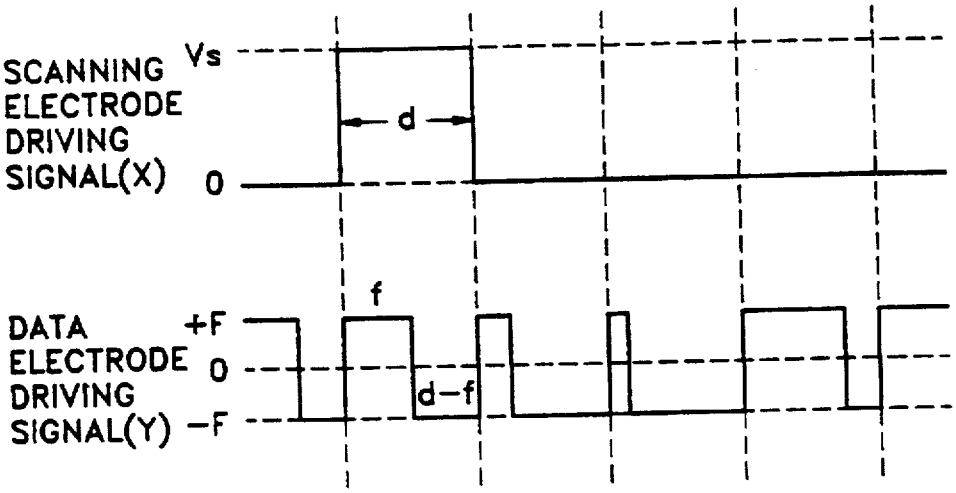
FIG. 4 (PRIOR ART)
FIG. 4 shows waveform diagrams of scanning and data electrode driving signals adopting a conventional amplitude modulation gray display method.
Figure 5:
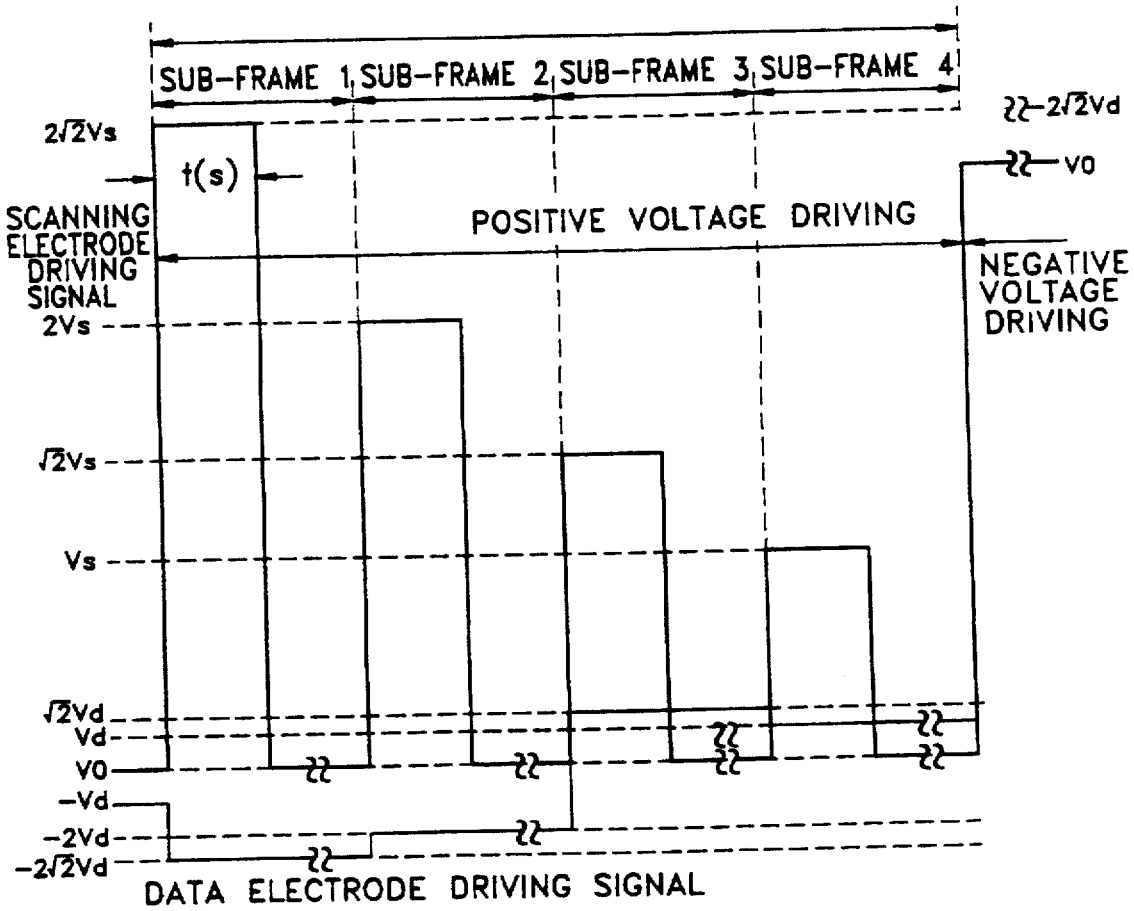
FIG. 5 (PRIOR ART)
FIG. 5 shows waveform diagrams of scanning and data electrode driving signals adopting a conventional voltage and frame modulation gray display method for displaying 16 gray levels.
Figure 6:
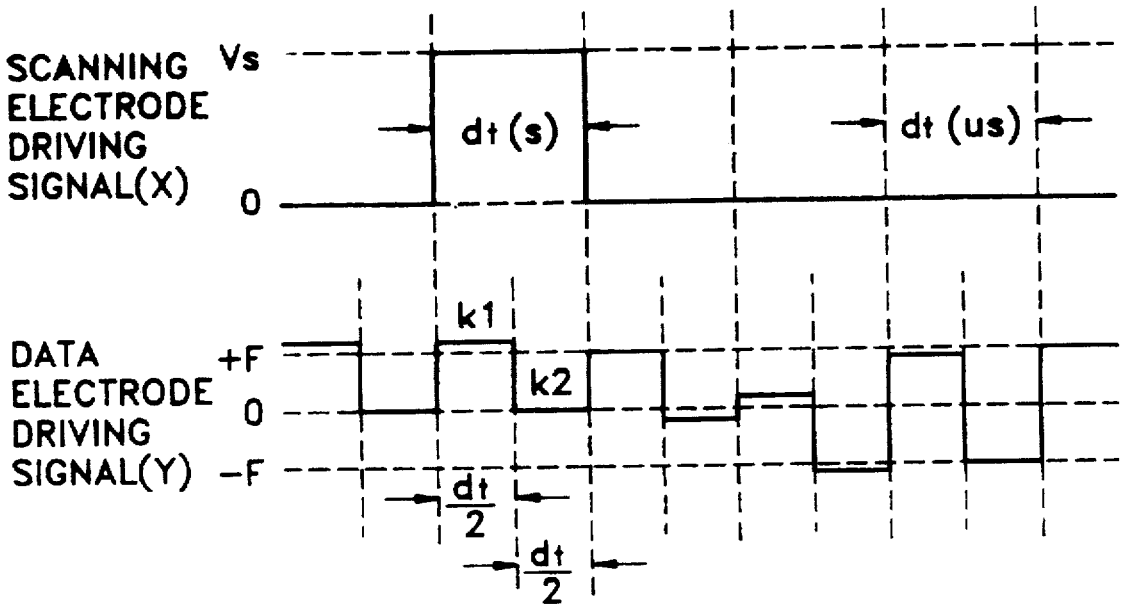
FIG. 6 (PRIOR ART)
FIG. 6 shows waveform diagrams of scanning and data electrode driving signals adopting a conventional amplitude magnitude modulation gray display method.
Figure 7:
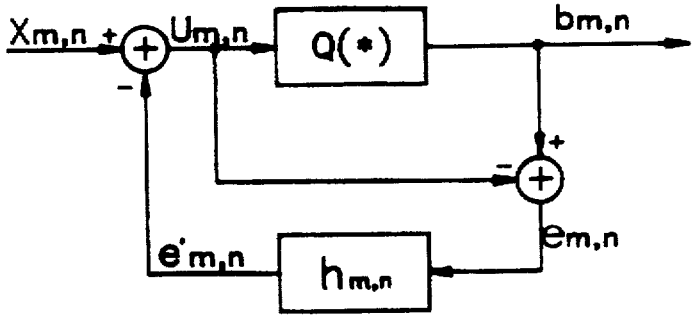
FIG. 7 is a block diagram of an error diffusion system.
Figure 8:
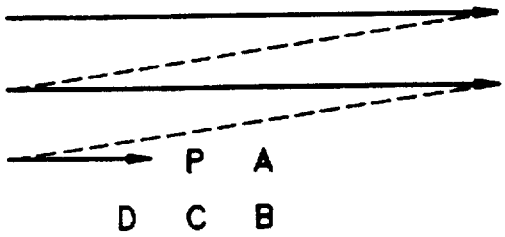
FIG. 8 illustrates an example of an error diffusion method.
Figure 9:
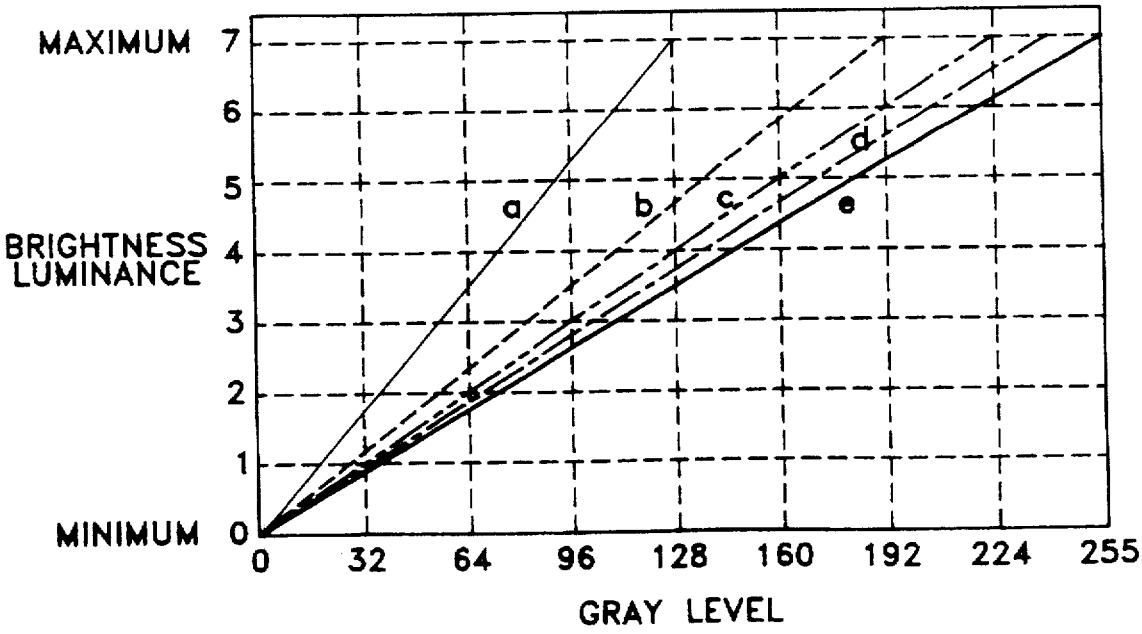
FIG. 9 is a graph showing the relationship between the number of gray levels and gray display capability on the hardware of an 8-bit data processor.

As indicated in table 4, the methods according to the present invention have uniform difference between effective voltages of the respective gray levels and no gray level reaches a saturation state which is shown in FIG. 9 in relating to the conventional error diffusion method. Also, unlike the conventional frame modulation gray display method, the number of sub-frames used for constituting a screen is greatly reduced. A gray scale display is allowed simply by using a switching circuit without adding the number of gray levels output from the driven IC. Also, code conversion is performed so that error diffusion is partially applied to the gray levels having low occurrence probability and weight value, which makes them less influential in the whole picture. Thus, error diffusion is adopted after performing an optimized code conversion while keeping the influence of the error diffusion in the overall picture quality extremely insignificant, thereby eliminating the saturation region of gray levels as shown in FIG. 9.

As described above, the gray display driving method for an LCD according to the present invention can greatly reduce the scanning and data electrode driving signal voltages and the driving voltage magnitude variation for the respective sub-frames It can also minimize the lowering of the picture quality due to spatial modulation by converting picture data into an optimum code for the LCD characteristics and system circumstances. Also, this method is useful for the conventional APT driving method, overlap driving method or plural electrode simultaneous selection driving method. Moreover, in view of a response speed, this method is useful for driving all kinds of simple matrix LCDs from slow response LCD's to quick response LCD's.

What is claimed is:

1. A method of driving a matrix liquid crystal display comprising the steps of:

determining an n-bit error-diffused value of N-bit picture data, where n is smaller than N;

converting said N-bit picture data into an M-bit code, where M is larger than or equal to N;

error-diffusing n-bits of said converted picture data; and displaying picture data of M-n bits, with n bits being error-diffused, as a picture by a gray display method.

2. A method according to claim 1, wherein:

the lowest significant bit is error-diffused if said error-diffused value is less than or equal to 1;

the lower two significant bits are error-diffused if said error-diffused value is less than or equal to 2;

the lower two significant bits are error-diffused if said error-diffused value is less than or equal to 3; and the lower three significant bits are error-diffused if said error-diffused value is less than or equal to 7.

3. A method according to claim 1, wherein the maximum of said converted M-n bits is determined to be the same as the maximum value of said N-bit picture data.

4. A method according to claim 2, wherein the maximum of said converted M-n bits is determined to be the same as the maximum value of said N-bit picture data.

5. A method according to claim 1, wherein the picture data codes are converted so that the difference between weight values for the respective bits of the converted M-n bit data is smaller than that of the N-bit picture data.

6. A method according to claim 2, wherein said picture data codes are converted so that the difference between weight values for the respective bits of said converted M-n bit data is smaller than that of said N-bit picture data.

7. A method according to claim 3, wherein said picture data codes are converted so that the difference between weight values for the respective bits of said converted M-n bit data is smaller than that of said N-bit picture data.

8. A method according to claim 4, wherein said picture data codes are converted so that the difference between weight values for the respective bits of said converted M-n bit data is smaller than that of said N-bit picture data.

9. A matrix liquid crystal display driving apparatus comprising:

means for (a) determining an n-bit error-diffused value of N-bit picture data, where n is smaller than N; (b) converting said N-bit picture data into an M-bit code, where M is larger than or equal to N; and (c) error-diffusing n-bits of said converted picture data; and means for displaying picture data of M-n bits with n bits being error-diffused by a gray display method.

* * * * *